United States Patent [19]

Mizelle

[11] 4,099,775

[45] Jul. 11, 1978

[54] CHAIR CONTROL WITH TILT LOCK

[75] Inventor: Ned W. Mizelle, Lexington, Ky.

[73] Assignee: Hoover Ball and Bearing Company, Saline, Mich.

[21] Appl. No.: 730,161

[22] Filed: Oct. 7, 1976

[51] Int. Cl.[2] ..... A47C 3/026

[52] U.S. Cl. ..... 297/303; 297/328

[58] Field of Search ..... 297/328, 327, 325, 269, 297/270, 313, 302, 303; 248/397, 382, 371, 373

[56] References Cited

U.S. PATENT DOCUMENTS

| | | | |
|---|---|---|---|
| 54,869 | 5/1866 | Cronk | 248/397 |
| 179,859 | 7/1876 | Kubitschky et al. | 297/328 X |
| 2,424,753 | 7/1947 | Herold | 297/303 X |
| 2,829,704 | 4/1958 | Hallett et al. | 297/328 X |
| 3,480,249 | 11/1969 | Lie | 297/328 X |
| 3,784,147 | 1/1974 | Harder | 297/313 X |

FOREIGN PATENT DOCUMENTS

| | | | |
|---|---|---|---|
| 669,160 | 9/1965 | Belgium | 297/328 |
| 566,461 | 9/1957 | Italy | 297/327 |

*Primary Examiner*—Francis K. Zugel
*Attorney, Agent, or Firm*—Olsen and Stephenson

[57] ABSTRACT

A chair control comprising a frame structure adapted to be supported on a conventional chair base, a chair seat support pivotally mounted on the frame structure for fore and aft tilting movement relative to the frame structure, a biasing structure such as a torsion bar biasing the seat support to a position corresponding to a normal seating position of a chair seat, and rotatable blocking members mounted on the seat support for movement, in a tilted position of the seat support, to a position engaged with the frame structure so as to block return movement of the seat support to the normal position. The blocking members are operable by an actuating knob conveniently located close to the seat for operation by the seat occupant and are moveable to a plurality of positions corresponding to various tilted positions of the chair. This tilt lock structure enables the chair occupant to sit comfortably in the chair in a tilted position of the seat without having to fight the continuous tendency of the chair to return to the normal seating position.

1 Claim, 5 Drawing Figures

CHAIR CONTROL WITH TILT LOCK

SUMMARY OF THE INVENTION

It is desirable, from the standpoint of comfort, to be able to retain a tiltable chair in a tilted position, and some tilting chairs have included structure for maintaining the chair in a tilted position. However, it is now recognized that the seating comfort of the chair occupant is improved if the occupant is enabled to still move the chair seat in a fore and aft direction even when the chair seat is blocked against returning to its normal seating position. It is an object of the present invention, therefore, to provide an improved chair control in which in a given tilted position of the chair seat, the seat is blocked against return movement to its normal position, but the occupant is permitted to tilt the chair further back from the tilt lock position and thence forward again to the tilt lock position so that occupant movement is not totally restricted in any tilt lock position of the chair.

The chair control of this invention comprises a frame structure supportable by the usual chair base, seat support members pivotally mounted on the frame structure for tilting movement relative to the frame structure, bias means, such as a torsion bar, operatively associated with the frame structure and the seat support members biasing the seat support members to normal positions relative to the frame structure, and blocking means movably mounted on the seat support members for movement in a tilted position of the seat support members to positions engaged with the frame structures so as to block return movement of the seat support members to the normal position. When the blocking members block return movement of the seat support members, the seat occupant does not have to fight the normal tendency of the chair to return to a normal seating position, thus improving occupant comfort. In addition, the occupant is allowed to tilt the seat further back and return the seat forwardly as far as the position in which it is blocked. This ability of the seat occupant to more or less rock the chair back and forth from its tilt lock position further improves occupant comfort. The seat locking means consists of a pair of rotatably mounted members, each of which has a plurality of surfaces engageable with the frame structure to block return movement of the seat to the normal position from a plurality of tilted positions that are selectable by the chair occupant. The blocking members are mounted on a shaft which is operable by rotating an actuating knob conveniently positioned for the seat occupant immediately below and adjacent one edge of the chair seat.

The tilt lock chair control of this invention thus achieves increased chair occupant comfort in tilting seat chairs of the type that are in common use.

Further objects, features, and advantages of this invention will become apparent from a consideration of the following description, the appended claims, and the accompanying drawing in which;

Figure 1:
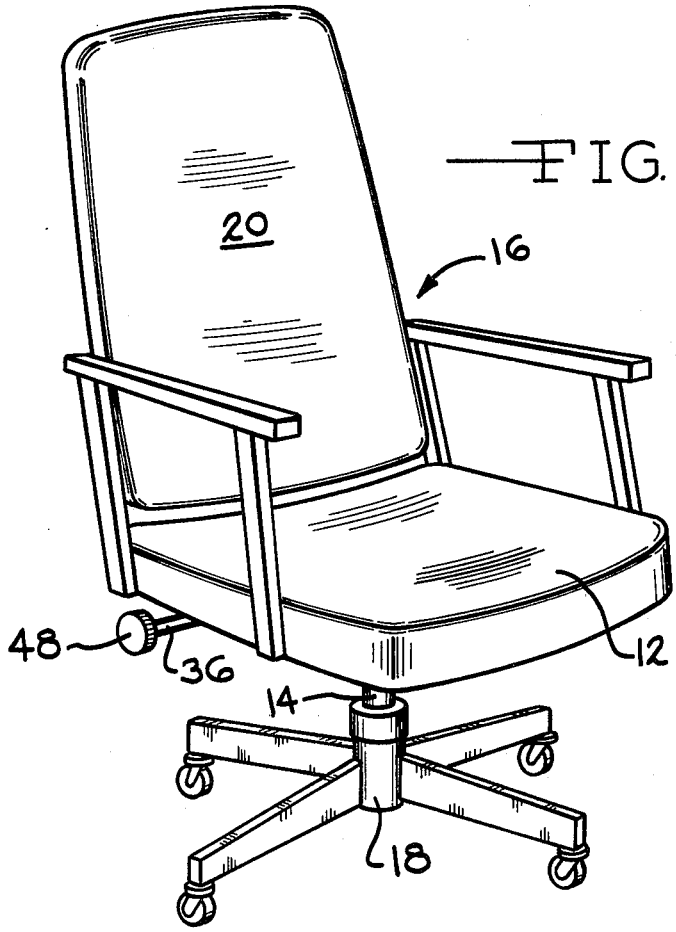
FIG. 1 is a perspective view of a chair provided with the tilt lock chair control of this invention.
Figure 2:
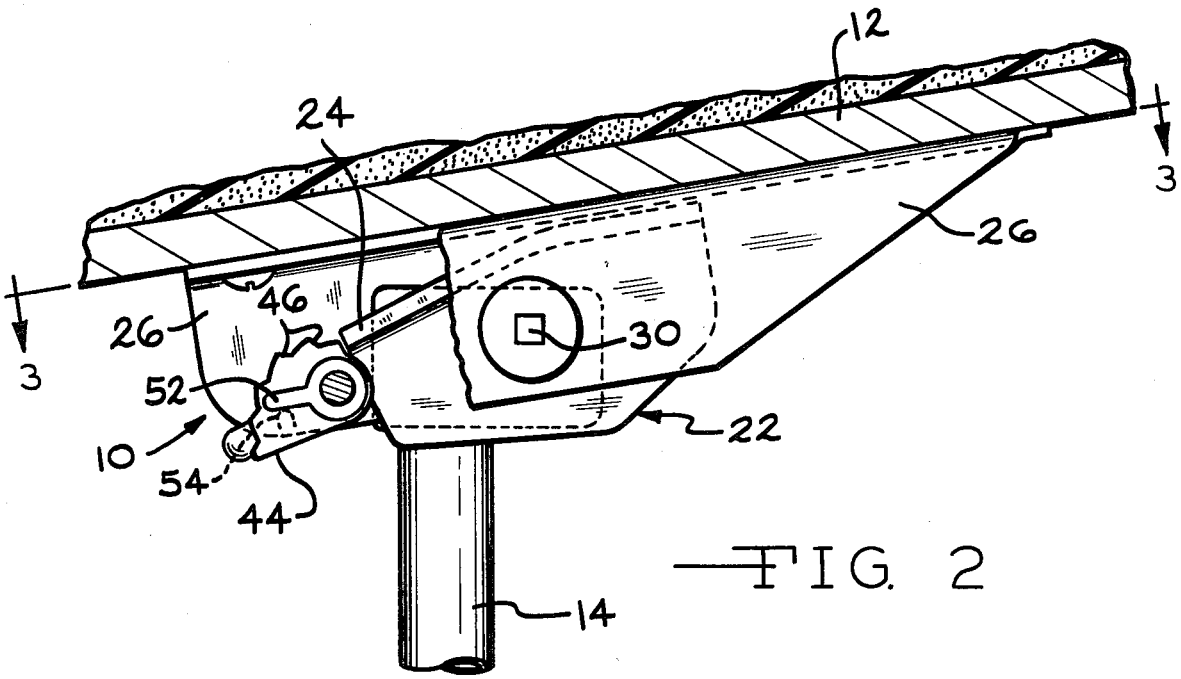
FIG. 2 is a fragmentary side elevational view of the chair control of this invention, showing the chair control in assembly relation with a chair seat and a chair support, with some parts broken away and other parts shown in section for the purpose of clarity and illustrating the chair seat in the normal position.

With reference to the drawing, the chair control of this invention, indicated generally at 10, is illustrated in FIG. 2 secured to the under side of a seat 12 and mounted on the upper end of a support pedestal 14 for a chair, indicated generally at 16 in FIG. 1. As shown in FIG. 1, the chair 16 has, in addition to the seat 12 and the pedestal 14, a supporting base 18 on which the pedestal 14 is mounted and a seat back 20 located at the rear edge of the seat 12.

A frame structure 22, which includes a pair of angle shaped frame members 24 that extend fore and aft of the seat 12, is rigidly mounted on the upper end of the pedestal 14. A pair of angle shape seat support members 26 (FIG. 3) parallel to and positioned outwardly of the frame members 24 are secured to the underside of the seat 12. A conventional torsion bar assembly 28 connects the seat support members 26 to the frame members 24. The torsion bar assembly 28 consists of an elongated torsion bar 30, illustrated as being of rectangular shape in cross-section, which is secured at one end by an attachment member 32 to the seat support member 26. Adjacent its opposite end, the torsion bar 30 is secured by an attachment member 34 to one of the frame members 24. The torsion bar 30 acts as a bias means to bias the seat support members 26 to normal seating positions relative to the support structure 18, namely, positions corresponding to a normal seating position of the seat 12 untilted with respect to the support structure 18 and shown in FIG. 2. When the seat support members 26 are tilted upwardly and rearwardly by the seat occupant desiring the seat 12 in a tilted position, the torsion bar 30 is twisted between the attachment members 32 and 34 and the tendency of the torsion bar 30 to return to its untwisted position, corresponding to the normal position of the seat 12 shown in FIG. 2, biases the seat support members 26 toward this position. Thus, in a conventional chair equiped with biasing means such as the torsion bar 30, when the seat occupant tilts the seat 12 rearwardly, and wants to keep the seat 12 in a rearwardly tilted position, the seat occupant must continually fight the tendency of the seat 12 to return to its normal position by virtue of the tendency of the torsion bar 30 to return to its untwisted position.

Figure 3:
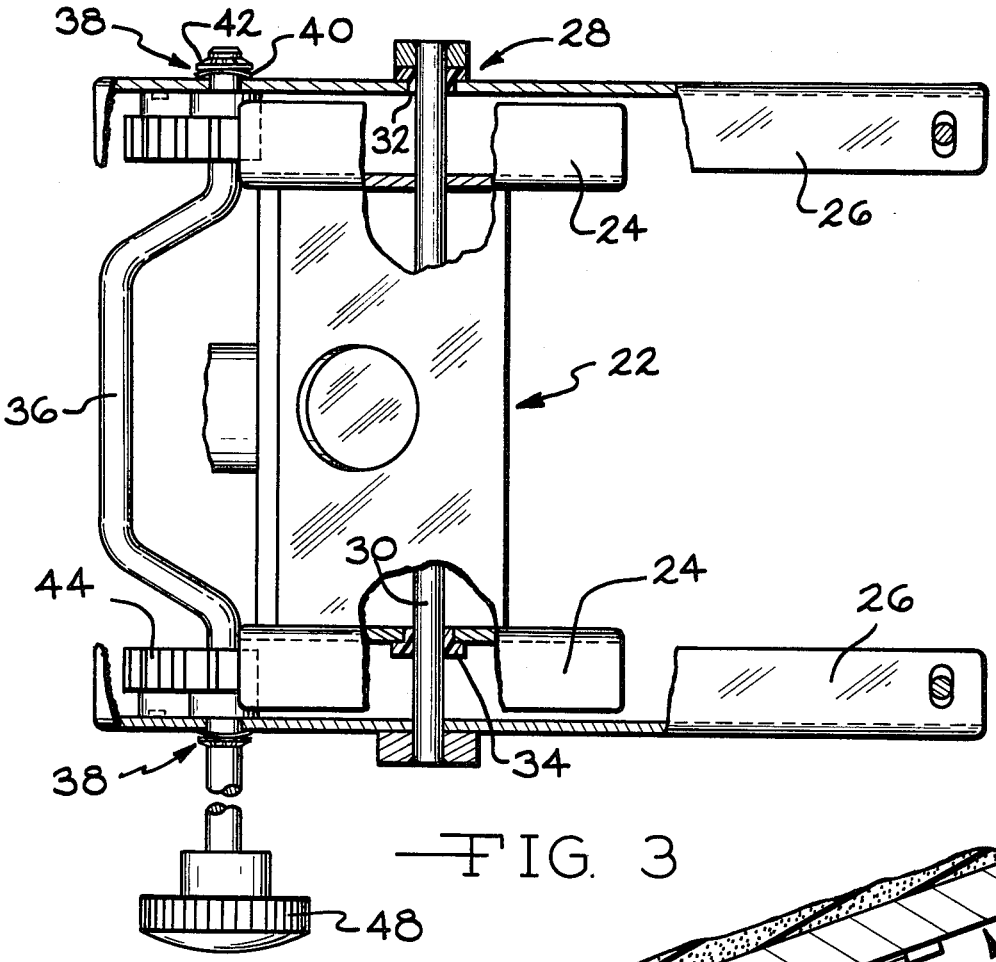
FIG. 3 is a top plan view of the chair control of this invention as seen from substantially the line 3—3 in FIG. 2, with some parts broken away and other parts shown in section for the purpose of clarity.

In the chair control of this invention, a shaft 36 which in the illustrated embodiment of the invention is of the irregular shape shown in FIG. 3 to avoid conflict with other parts of the chair control, is rotatably supported on the seat support members 26 so as to extend therebetween. A washer assembly 38, consisting of a spring washer 40 engaged with a seat support member 26 and a fastener washer 42 engaged with the spring washer 40, is mounted on the shaft 36 adjacent each of the seat support members 26 to provide sufficient frictional resistance to rotation of the shaft 36 to maintain the shaft 36 in a rotated position. Inwardly of and adjacent each of the seat support members 26, an irregularly shaped blocking member 44 is secured to the shaft 36. Each blocking member 44 is provided on its circumference with a plurality of blocking surfaces 46 which are located at different positions spaced radially outwardly from the shaft 36, the magnitude of the radial spacing increasing in a counter-clockwise direction on the circumference of the blocking members 44 as viewed from FIG. 2. A knurled actuating knob 48, mounted on one end of the shaft 36, is located adjacent and immediately below one edge of the seat 12 so that the seat occupant can readily grasp the knob 48 and rotate the shaft 36 so as to in turn rotate the blocking members 44 for the purpose hereinafter described.

In the operation of the chair control 10, assume that the seat 12 is in its normal position shown in FIG. 2. Further assume that the seat 12 is then tilted upwardly and rearwardly, as indicated by the arrow 50 in FIG. 4 to the tilted position illustrated in FIG. 4. Also assume that the shaft 36 is in a position in which the blocking members 44 are in the inoperative positions illustrated in FIG. 4. These positions are defined by engagement of a stop 52 secured to each of the blocking members 44 with a stop 54 which is struck out of each of the seat support members 26. To place the blocking members 44 in the inoperative positions, the handle 48 is grasped and rotated in a counter-clockwise direction as viewed in FIG. 4 until the stops 52 engage the stops 54.

Figure 4:
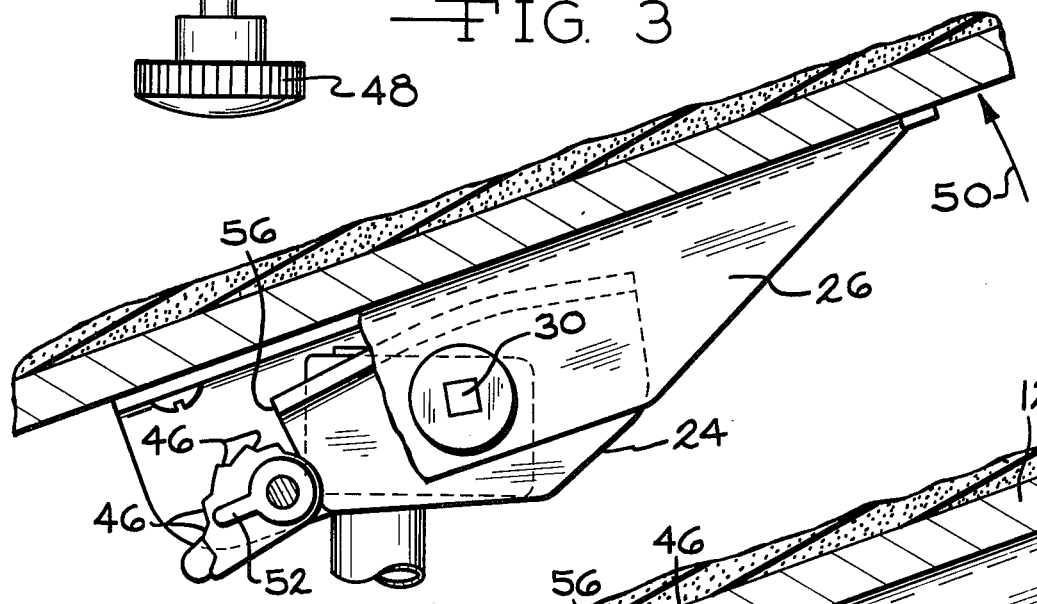
FIG. 4 is an elevational view of the chair control of this invention, illustrated similarly to FIG. 2, showing the seat in a rearwardly tilted position and with the blocking members in retracted or inoperative positions.
Figure 5:
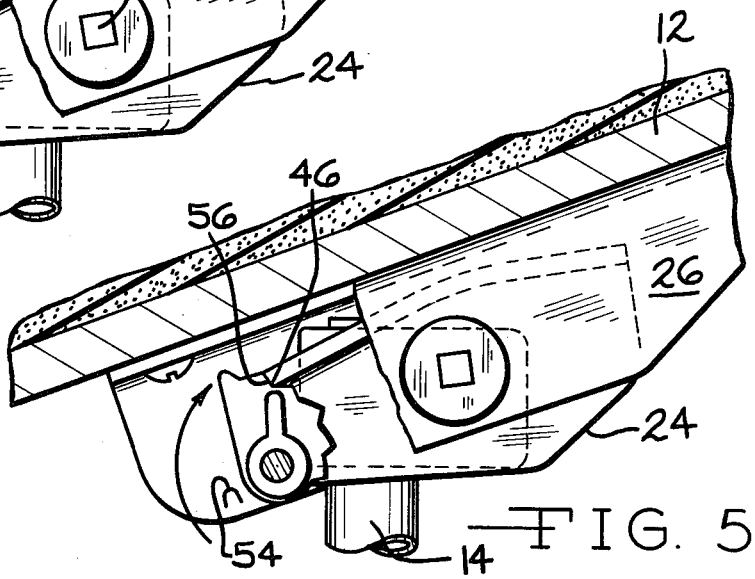
FIG. 5 is an elevational view like FIG. 4, showing the seat in a tilted position and showing the blocking members moved to blocking positions in which they function to block return movement of the seat to a normal position.

Now assume that the chair occupant desires to retain the chair seat 12 in the tilted position shown in FIG. 4. The occupant manually grasps the knob 48 and rotates the knob 48 in a clockwise direction as viewed in FIG. 4 until the blocking surfaces shown at 46 in FIG. 5 engage the rear edges 56 of the frame members 24. In these positions of the blocking members 44, the seat support members 26 are positively blocked against return movement, under the action of the torsion bar 30, to the normal positions illustrated in FIG. 2. As shown in FIGS. 4 and 5, each blocking member 44 has a plurality of blocking surfaces 46 to thus enable the chair occupant to lock the seat 12 in a plurality of tilted positions. In the illustrated enbodiment of the invention, six surfaces 46 are provided on each blocking member 44 and these surfaces 46 correspond to six different tilted positions of the seat 12, with about a three degree increment of tilt between adjacent tilted positions.

It is readily apparent that the blocking members 44 can be constructed so as to block return movement of the seat 12 from substantially any desired tilted position of the seat 12. It is also apparent that when the blocking members 44 operate to block return movement of the chair seat 12 to a normal position, they do not in any way interfere with further rearward tilting of the seat 12 from the tilt locked position, namely, the most forwardly tilted position in which the chair seat can be placed. Thus, the chair occupant is allowed to tilt the chair back and forth starting from the position in which the chair is locked against further forward movement. This provides the chair occupant with additional seating comfort heretofore unavailable in tilting seat type chairs because the chair is not rigidly locked in a tilt lock position.

From the above description it is seen that this invention provides a tilt lock chair control which is selectively operable by the chair occupant to block return movement of a tilted chair seat to the normal position. This enables the chair occupant to enjoy seating in a reclined position without having to fight the tendency of the chair seat to return to the normal position. Further, in the chair control of this invention, the chair occupant has the opportunity to move the chair fore and aft when the chair is in a locked tilted position because only chair movement in the "return to normal position direction" is blocked. The chair occupant can still rock the chair further back starting from the tilt lock position. Thus, the chair control of this invention provides for increased chair occupant comfort and with increased chair position options available to the chair occupant.

What is claimed:

1. A chair control comprising a frame structure supportable by a base, seat support means pivotally mounted on said frame structure for tilting movement relative to said frame structure, bias means operatively associated with said frame structure and said seat support means biasing said support means to a normal position relative to said frame structure in all tilted positions of said support means, said seat support means supported on the front of said frame structure in said normal position, a multiposition member comprising a body having a plurality of angularly arranged blocking surfaces, a shaft member the rear of on said seat support means movably supporting said body thereon for movement between frictionally adjusted positions in one of which said blocking surfaces are disengaged from the rear edge said frame structure and another selectible position in a tilted position of said seat support means in which one of said blocking surfaces is engaged with said rear edge of said frame structure so as to block return movement of said seat support means to said normal position while enabling further tilting of said seat support means away from said normal position, and coacting stop means on said body and said seat support means engageable to define a moved position of said body in which said body is in a clearance relation with the rear of said frame structure to allow return movement of said seat support means to said normal position and free rearward tilting movement of said seat means.

* * * * *